US005965050A

United States Patent [19]

Ripley et al.

[11] Patent Number: 5,965,050

[45] Date of Patent: Oct. 12, 1999

[54] CURVED GRAPHITE HEATING ELEMENT FOR AN ELECTRIC RESISTANCE HEATING FURNACE

[75] Inventors: Fred W. Ripley, Perkasie; David Rinz, Lower Gwynedd, both of Pa.

[73] Assignee: Vacuum Furnace Systems Corp., Souderton, Pa.

[21] Appl. No.: 09/172,481

[22] Filed: Oct. 14, 1998

Related U.S. Application Data

[63] Continuation of application No. 29/053,583, Apr. 25, 1996.

[51] Int. Cl.[6] ..... H05B 3/10

[52] U.S. Cl. ..... 219/552; 219/549; 219/545

[58] Field of Search ..... 219/549, 542, 219/541, 539, 545, 520, 528, 529, 408, 409; 373/109, 117, 119, 134

[56] References Cited

U.S. PATENT DOCUMENTS

| | | | |
|---|---|---|---|
| 4,410,796 | 10/1983 | Wilsey | 219/553 |
| 4,503,319 | 3/1985 | Moritoki et al. | 219/390 |
| 4,755,658 | 7/1988 | Wilsey | 219/541 |

*Primary Examiner*—Teresa Walberg
*Assistant Examiner*—Shawntina Fuqua
*Attorney, Agent, or Firm*—Duane Morris & Heskscher LLP; Steven E. Koffs

[57] ABSTRACT

A heating element is formed of graphite. The heating element has a curved shape. The heating element is capable of resisting electricity to generate heat. A method for forming the heating element comprises the steps of: forming a plurality of graphite heating element segments, each segment having a curved shape; and assembling the plurality of graphite heating element segments to form a heating element.

8 Claims, 1 Drawing Sheet

CURVED GRAPHITE HEATING ELEMENT FOR AN ELECTRIC RESISTANCE HEATING FURNACE

This application is a continuation of U.S. application No. 29/053,583, filed Apr. 25, 1996.

FIELD OF THE INVENTION

The present invention relates to heating elements for furnaces.

DESCRIPTION OF THE RELATED ART

Many manufacturing processes require heat treatment in vacuum. Processing in a vacuum prevents damage or destruction of the processed materials due to chemical reactions that would otherwise occur in a normal 20% oxygen atmosphere.

A vacuum furnace typically includes a cylindrical vacuum chamber having a plurality of electric resistance heating elements on its interior surface. These heating elements may be circular bands of a metal such as molybdenum, and may be arranged at even intervals along the length of the chamber.

When molybdenum heating elements are heated to increasingly higher temperatures in vacuum, the possibility of outgassing by the heating elements becomes a concern. Such outgassing is undesirable, because it may result in the processed workpieces becoming coated with a thin molybdenum film, or the surface of the workpiece may react with the metal vapor.

An improved heating element is desired.

SUMMARY OF THE INVENTION

The present invention is a heating element formed of graphite. The heating element has a curved shape. The heating element is capable of resisting electricity to generate heat.

According to another aspect of the invention, a method for forming a heating element, comprises the steps of: forming a plurality of graphite heating element segments, each segment having a curved shape; and assembling the plurality of graphite heating element segments to form a heating element.

DETAILED DESCRIPTION

Figure 1:
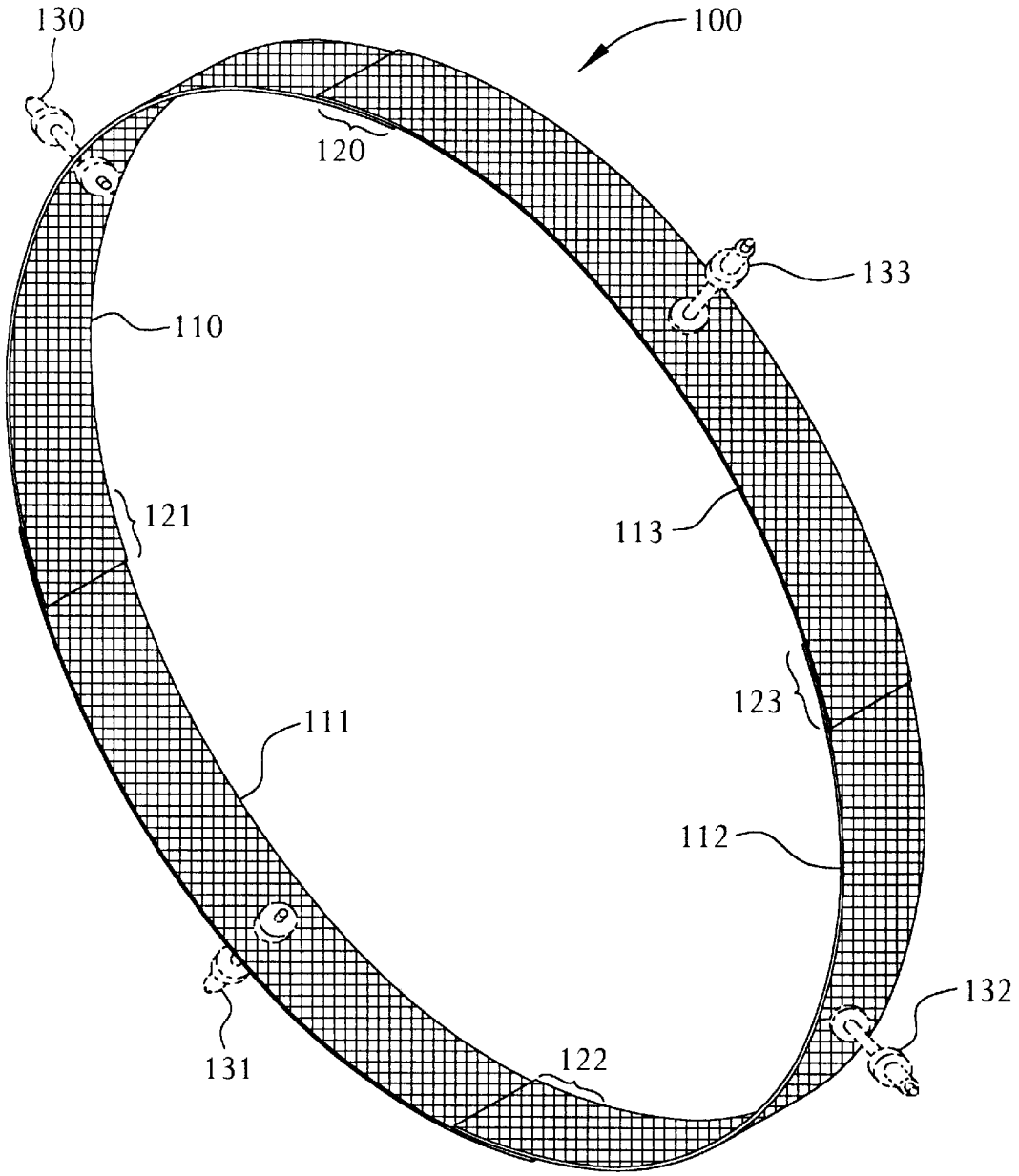
FIG. 1 is an isometric view of an exemplary heating element according to the present invention.

U.S. patent application No. 29/053,583, filed Apr. 25, 1996, is expressly incorporated herein by reference in its entirety.

FIG. 1 shows a heating element 100. The heating element 100 is formed of graphite. The heating element 100 has a curved, circular shape. The heating element is capable of resisting electricity to generate heat thereby.

One of ordinary skill in the art of fabricating graphite components understands the fabrication challenges associated with using graphite. One of the most challenging aspects of using graphite is its limited ability to bend elastically. Further, graphite is a very soft material. Forming a large circular hoop of graphite from a single piece without breakage may be difficult, and there is a chance of breakage during use, due to thermal cycling.

The inventor has determined that it is possible to overcome these disadvantages of graphite by forming a plurality of graphite arcs separately, and assembling the arcs together to form the circle.

The heating element 100 comprises a plurality of segments. In the example, four segments 110–113 interface with one another. Each of the segments 110–113 overlaps two adjacent ones of the plurality of segments. For example, segment 110 overlaps segments 113 and 111, segment 111 overlaps segments 110 and 112, segment 112 overlaps segments 111 and 113, and segment 113 overlaps segments 112 and 110.

As is readily apparent from FIG. 1, the overlap regions 120–123 are substantially greater in length than the thickness of the graphite arcs. For example, in a heating element having a radius of about 19 inches and width of about 4.0 inches, there is an overlap region about 3.0 inches long at each end of the segment. The thickness of the non-overlapping portions of each segment is about 0.125 inches. Thus, the surface area of one of the overlap sections 120–123 is substantially greater than the cross sectional area of a single thickness of graphite.

Hence, even if the conductive interface between segments in the overlap regions 120–123 is not high, the electrical resistance of the overlap regions should not substantially exceed the resistance of the non-overlapping portions of the arcs 110–113. Further, in the example, each overlapping region 120–123 has a respective fastener (not shown), such as a molybdenum bolt, to improve contact and the thermal interface between segments. The length of the overlap regions 120–123 is substantially less than the length of the arcs 110–113. Thus, the primary resistance heating contributions occur in the non-overlapping portions of the element, the dimensions of which are easily controlled.

Two of the segments 111 and 113 are outer segments, and two of the segments 110 and 112 are inner segments. In the example, the outer segments 111, 113 and the inner segments 110, 112 are all formed to have the same circular shape. Each segment 110–113 has a hole for receiving a center fastener 130–133, and is supported by its respective fastener 130–133. In addition, each segment is fastened to the two adjacent segments.

Although there are a total of eight fasteners, only four of the eight fasteners (one per segment) contact the wall.

Other conventional methods and fasteners known to those of ordinary skill in the art may also be used to attach the heating element 100 to the interior wall of the furnance.

One of ordinary skill recognizes that the segment shapes may be varied, so the outer segments 111 and 113 exert an inward force at each end of inner segment 110. For example, the outer segments may have a slightly smaller radius of curvature, and the inner semgents may have a slightly larger radius of curvature, so the inner segment 110 exerts opposing outward forces on outer segments 111 and 113. Similar pairs of equal and opposite forces would be exerted at each of the overlapping sections 120–123.

In the above described variation, a single fastener 130–133 may be used for each respective segment 110–113. The fasteners 130–133 are used to attach the heating element 100 to the inner wall of a vacuum furnace (not shown).

As one of ordinary skill recognizes, graphite is naturally black in color. In a vacuum furnace environment, thermal radiation is the predominant mode of heat transfer, and a flat black surface is the best finish for emitting diffuse thermal radiation throughout the pertinent portion of the spectrum. Thus, the claimed heating element has an advantageous surface for emitting thermal radiation.

Although the example shows four segments 110–113, other numbers of segments may also be used.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A heating element comprising:

a plurality of segments interfacing with one another, each segment overlapping two adjacent ones of the plurality of segments, the heating element having a substantially constant width and thickness, except in portions where segments overlap, said heating element having a curved shape, said heating element being capable of resisting electricity to generate heat thereby, said heating element being formed of graphite.

2. The heating element of claim 1, wherein the curved shape is substantially circular.

3. The heating element of claim 1, wherein the plurality of segments include four segments assembled in a circle, two of the segments being outer segments, two of the segments being inner segments.

4. The heating element of claim 1, wherein each segment has a hole for receiving a single fastener that is connectable to a wall.

5. The heating element of claim 1, wherein each segment has the preformed shape of an arc.

6. A method for forming a heating element, comprising the steps of:

forming a plurality of graphite heating element segments, each segment having a curved shape;

assembling the plurality of graphite heating element segments to form a heating element, including the step of overlapping each segment with an adjacent one of the plurality of segments, the heating element having a substantially constant width and thickness, except in portions where segments overlap.

7. The method of claim 6, wherein the step of assembling includes forming a circle from the segments.

8. The method of claim 6, wherein the step of assembling includes assembling four segments in a circle, two of the segments being outer segments, two of the segments being inner segments.

* * * * *